US007221282B1

(12) United States Patent
Ross et al.

(10) Patent No.: US 7,221,282 B1
(45) Date of Patent: May 22, 2007

(54) WIRELESS WASTEWATER SYSTEM MONITORING APPARATUS AND METHOD OF USE

(75) Inventors: Allan L. Ross, San Diego, CA (US); William D. McWhirter, Mason, OH (US); John S. Weaver, Cincinatti, OH (US); Paul R. Jordan, Blanchester, OH (US); Arthur DeBolt, Los Alamitos, CA (US)

(73) Assignee: Wireless Telematics LLC, La Jolla, CA (US)

( * ) Notice: Subject to any disclaimer, the term of this patent is extended or adjusted under 35 U.S.C. 154(b) by 136 days.

(21) Appl. No.: 10/785,876

(22) Filed: Feb. 24, 2004

(51) Int. Cl.
*G08B 21/00* (2006.01)

(52) U.S. Cl. ..... 340/618; 340/603; 340/606; 340/616

(58) Field of Classification Search ..... 340/618, 340/605, 603, 606, 3.1, 506, 616; 4/314, 4/415; 210/614, 143, 151
See application file for complete search history.

(56) References Cited

U.S. PATENT DOCUMENTS 5,591,010 A * 1/1997 Van Zyl ..... 417/12
6,139,744 A * 10/2000 Spears et al. ..... 210/614
6,802,084 B2 * 10/2004 Ghertner et al. ..... 4/314
7,002,481 B1 * 2/2006 Crane et al. ..... 340/618

* cited by examiner

*Primary Examiner*—Davetta W. Goins
(74) *Attorney, Agent, or Firm*—Mind Law Firm; Jeromye V. Sartain

(57) ABSTRACT

A wireless wastewater system monitoring apparatus generally comprising a processor/transceiver unit, housed within a synthetic protective enclosure formed outside of the wastewater system, and a fluid level sensor configured to send an overflow signal to the processor/transceiver unit when an overflow condition in the wastewater system is detected. The processor/transceiver unit is configured with at least one microprocessor wired between the sensor and a power supply and with a transceiver so as to detect the overflow signal from the sensor and, in response, transmit a wireless alarm signal. The processor/transceiver unit is further configured such that only a portion of its circuitry is constantly powered so as to continuously monitor the sensor, while the remainder of its circuitry, including the transceiver, is only powered and a wireless signal sent from the unit when an overflow condition is detected or a routine status-check is being conducted.

35 Claims, 6 Drawing Sheets

WIRELESS WASTEWATER SYSTEM MONITORING APPARATUS AND METHOD OF USE

BACKGROUND OF THE INVENTION

1. Incorporation by Reference

Applicant hereby incorporates herein by reference any and all U.S. patents and U.S. patent applications cited or referred to in this application.

2. Field of the Invention

This invention relates generally to fluid level monitoring devices, and more particularly to wireless wastewater system monitoring devices.

3. Description of Related Art

A municipal sanitary wastewater system is designed to transport waste material for the community. Spillage of waste material is of major concern to the system operator, the municipality, and the ratepayers in the community. Accordingly, these concerns have led to increasing environmental regulations and resultant penalties for sewer overflows.

As a result, efforts have been made in the art to semi-automate and automate the monitoring of wastewater systems as a means of early detection of sewage backups and rising sewage levels in the hopes of correcting such conditions before sewage overflows occur. In doing so, numerous difficulties have been encountered and heretofore not optimally addressed. Generally, the monitoring device, which essentially includes a sensor, a processor, a wireless transceiver, and a power supply, is installed within a manhole of a wastewater system so as to monitor the wastewater level and report an overflow condition through a wireless alarm transmission. Inherently, the monitoring device is exposed to the contaminating and corrosive environment of the wastewater system, often leading to premature failures of the devices. Further, by locating the monitoring device in the manhole of the wastewater system, additional difficulties are encountered in attempting to get the wireless signal out of the manhole, as the signal is attenuated or interfered with primarily by the iron manhole cover. Often, to overcome the signal attenuating effects of the manhole, a stronger signal from the monitoring device is required, leading to increased device costs, power consumption, and even wireless airtime.

The following art defines the present state of this field:

U.S. Pat. No. 3,735,638 to Miller is directed to a liquid level measurement device relying upon the principle of a resistance bridge wherein the height sensing means is one resistor of the bridge. The height sensing resistor is comprised of a fine wire extending from the bridge circuit to a grounding rod. The fine wire extends generally parallel to, but spaced from, the grounding rod in order to constitute the height sensor. In use, the height sensor is inserted in the liquid whose height is to be measured in such a way that the grounding rod and the fine wire extend generally perpendicular to the liquid level line. Thus, the aqueous ionic media whose height is being measured will short out that portion of the fine wire below the liquid level to decrease the effective resistance of the height sensor. This has the effect of unbalancing the bridge circuit to give a reading on a meter that is an indication of the height of the liquid.

U.S. Pat. No. 4,136,561 to Mueller et al. is directed to a control module having circuitry for generating control and timing signals and for receiving digital data. A plurality of sensor modules are connected to the control module and each contains devices for sensing various physical characteristics, such as water level, rainfall or the like. In response to control signals generated by the control module, each of the sensor modules is operable to input digital data representative of the sensed physical characteristics to the control module. A recorder is connected to the control module and includes a removable recording cassette for recording the digital data transmitted from the sensor modules. The recorder also records the identification of the sensor module transmitting data, along with the calendar day and the time of day that the data was transmitted.

U.S. Pat. No. 4,335,606 to Michalak is directed to an apparatus for measuring the level of at least one fluid and includes an elongated transparent tubular member open at both ends, one of the ends being vertically insertable into the fluid to a reference point below the fluid surface to establish a column of the fluid in the tubular member having a length generally equal to the distance between the reference point and the fluid surface, a stiff tether slightly longer in length than the tubular member and threaded therethrough, a plug connected to one end of the tether for closing at least the inserted end of the tubular member prior to withdrawing it from the fluid to contain the column of the fluid in the tubular member for measurement after the tubular member is withdrawn from the fluid, and a grip connected to the other end of the cable for remotely controlling the plug to close the inserted end of the tubular member. In the process of measuring the fluid level, the column of the fluid can be viewed through the tubular member to check for abnormalities in the fluid and the presence or absence of other immiscible fluids.

U.S. Pat. No. 5,608,171 to Hunter et al. is directed to a distributed, unattended wastewater monitoring system that uses advances in low-energy signal processing and distributed microelectromechanical systems and that involves wireless interrogation of distributed, low-power, normally-off sensors. In a preferred embodiment, a plurality of flowmeter stations and at least one rain gauge station are networked through a base station for storm water discharge of infiltration-inflow monitoring. Wireless transceivers are used to transmit radio signals into and out of a sewer manhole.

Japanese Patent App. No. JP 2002/054167 to Pentafu et al. is directed to a remote monitor for a manhole provided with a sensor part installed in the manhole within the area of a cellular phone network, a data logger part whereinto a measured value from the sensor part is input, a communication device part for emitting the data from the logger part as an electromagnetic wave, a power source part for driving the sensor part, the logger part and the device part, and a central processing part for receiving the electromagnetic wave from the device part through the network. The device part and the source part are housed in the storage part, installed below a cover body of a manhole cover having a through hole closed by the cover body, the cover body eliminating the interception of the electromagnetic wave.

U.S. Pat. No. 6,507,686 to Heinz et al. is directed to a cable network with a light waveguide cable which is introduced in the pipeline of an existing pipeline system. The light waveguide cable is arranged along a line, preferably at the vertex of the pipeline, and is provided with a protective layer so that a smooth transition exists between the wall surfaces of the pipeline and the cable.

Japanese Patent App. No. JP 2003/074081 to Megumi et al. is directed to a remote monitoring device provided with a battery, an opening-closing detecting switch for operating according to opening-closing of a manhole cover, a power supply unit for starting power source supply from the battery by operation of the opening-closing detecting switch and stopping the power source supply by receiving a power supply stopping signal, a controller for starting operation by the power source supply by the power supply unit and outputting transmission data including information capable of specifying a manhole, a communication unit having a transmission circuit for starting operation by the power supply unit and transmitting the transmission data from the controller to a management center via an antenna, and a receiving circuit for receiving the signal from the management center via the antenna and transmitting the power supply stopping signal to the power supply unit.

U.S. Patent App. No. US 2003/0192379 to Ridenour et al. is directed to an apparatus and a method for monitoring a liquid level in a 4–20 mA closed loop system. A process instrument and a measuring unit are powered for a predetermined time and power is provided by a battery.

The prior art described above teaches a liquid level measurement device, an apparatus for automatically sensing and recording data in a sewage system, an apparatus and method for measuring fluid, a distributed, unattended wastewater monitoring system, a remote monitor for manhole, a cable network with light waveguide cable for installation in pipelines of existing supply line systems, a remote monitoring device of manhole, and a water well monitoring system, but does not teach a wireless wastewater system monitoring apparatus wherein the processor/transceiver unit is located outside of the wastewater system or wherein the fluid level sensor's microprocessor is continuously powered while the processor/transceiver unit is only powered and a wireless signal sent when an overflow condition in the wastewater system is detected. The present invention fulfills these needs and provides further related advantages as described in the following summary.

SUMMARY OF THE INVENTION

The present invention teaches certain benefits in construction and use which give rise to the objectives described below.

The present invention is directed to a wireless wastewater system monitoring apparatus generally comprising a processor/transceiver unit, housed within a synthetic protective enclosure formed outside of the wastewater system, and a fluid level sensor configured to send an overflow signal to the processor/transceiver unit when an overflow condition in the wastewater system is detected. The processor/transceiver unit is configured with at least one microprocessor wired between the sensor and a power supply and with a transceiver so as to detect the overflow signal from the sensor and, in response, transmit a wireless alarm signal. The processor/transceiver unit is further configured such that only a portion of its circuitry is constantly powered so as to continuously monitor the sensor, while the remainder of its circuitry, including the transceiver, is only powered and a wireless signal sent from the unit when an overflow condition is detected or a routine status-check is being conducted. In one exemplary embodiment, the processor/transceiver unit includes two microprocessors, a first that is "always on" and a second that is "powered up" in response to an awake signal from the first and that then powers up and controls the transceiver. In a second exemplary embodiment, a single microcontroller having a standby clock mode and a normal clock mode achieves the minimal "always on" and responsive "powered up" function of the processor/transceiver unit. The enclosure within which the processor/transceiver unit is housed may be a lined hole adjacent to a manhole or an above-ground container. By locating the processor/transceiver unit outside of the wastewater system, and particularly a manhole, the unit is protected from the harmful, corrosive effects of the wastewater system and is able to transmit wireless signals more reliably and with relatively less power by avoiding the attenuating effects of the manhole cover.

In use, the processor/transceiver unit is positioned within the protective enclosure and the fluid level sensor is located in the wastewater system at a selected height above the normal fluid level. The processor/transceiver unit defaults to a standby mode in which the sensor is continuously powered by the power supply and monitored under the control of the microprocessor, while the other components of the processor/transceiver unit, including the transceiver, are not powered. When the fluid level rises and an overflow condition is detected, the sensor sends an overflow signal to the microprocessor of the processor/transceiver unit. In response to the overflow signal, the microprocessor then "awakens" the rest of the processor/transceiver unit and transmits a wireless alarm signal via the transceiver. The alarm signal, which contains information related to the location of the overflow condition, is routed through a wireless carrier to a network operations center for notification to the appropriate district operator for corrective action. Once the overflow condition has been corrected, a reset signal is transmitted to the district operator again through the wireless carrier and network operations center. The microprocessor may also be programmed to awaken at routine intervals and perform a status-check of the processor/transceiver unit, including verification of the remaining battery life, and send a status-result signal to the network operations center. The alarm, reset and status-result signals may be compressed before being transmitted by the processor/transceiver unit and decompressed upon receipt at the network operations center, thereby further reducing wireless airtime. By only powering up the entire processor/transceiver unit when an overflow condition has been detected or a routine status-check is being conducted, power consumption and wireless airtime are further minimized.

A primary objective of the present invention is to provide an apparatus and method of use of such apparatus that provides advantages not taught by the prior art.

Another objective is to provide such an invention capable of reducing the exposure of the wastewater system monitoring device processor/transceiver unit to the corrosive and contaminating effects of the wastewater system.

Yet another objective is to provide such an invention capable of reducing the attenuation of the wireless signals transmitted to and from the wastewater system monitoring device processor/transceiver unit.

A further objective is to provide such an invention capable of locating the wastewater system monitoring device processor/transceiver unit outside of the wastewater system.

Another objective is to provide such an invention capable of reducing the power consumption by the wastewater system monitoring device.

A still further objective is to provide such an invention capable of continuously monitoring the wastewater levels in the wastewater system while only selectively powering the other components of the wastewater system monitoring device.

Another objective is to provide such an invention capable of reducing the total wireless airtime used by the wastewater system monitoring device.

A still further objective is to provide such an invention capable of continuously monitoring the wastewater levels in the wastewater system while only selectively sending a wireless signal from the wastewater system monitoring device processor/transceiver unit.

Yet a still further objective is to provide such an invention capable of compressing and decompressing the wireless signals.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
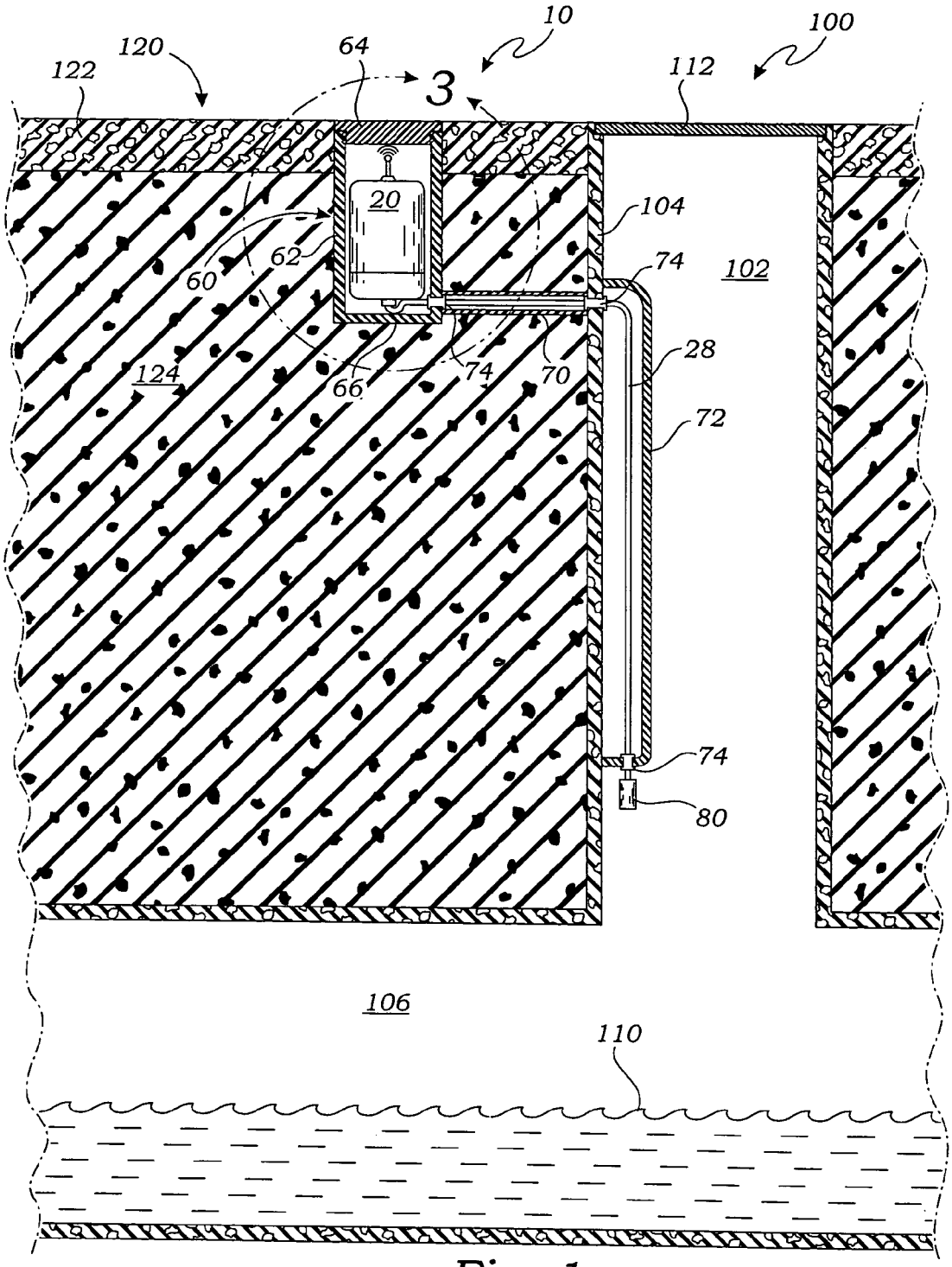
FIG. 1 is a sectional schematic of an exemplary embodiment of the invention.

The above-described drawing figures illustrate the invention in at least two of its preferred embodiments, which are further defined in detail in the following description.

The present invention is directed to a wireless wastewater system monitoring apparatus 10 generally comprising a processor/transceiver unit 20 housed within an enclosure 60, which is formed outside of the wastewater system 100, and connected to a fluid level sensor 80 configured to send an overflow signal to the processor/transceiver unit 20 when an overflow condition in the wastewater system 100 is detected. The processor/transceiver unit 20 is configured with at least one microprocessor 22 wired between the sensor 80 and a power supply 24 and a transceiver 26 so as to detect the overflow signal from the sensor 80 and, in response, transmit a wireless alarm signal, as explained in more detail below. It will be appreciated by those skilled in the art that by locating the processor/transceiver unit 20 outside of the wastewater system 100, and particularly a manhole 102, the processor/transceiver unit 20 is protected from the harmful, corrosive effects of the wastewater system 100 and is able to transmit wireless data more effectively. As such, it will be further appreciated that while specific exemplary embodiments of the wireless wastewater system monitoring apparatus 10 are shown and described, numerous other configurations are possible without departing from the spirit and scope of the invention.

Turning to FIG. 1, in an exemplary embodiment of the wireless wastewater system monitoring apparatus 10 of the present invention, the enclosure 60 is essentially a vertical unit hole 62 formed in the ground 120 adjacent to the manhole 102. In the case of a manhole 102 formed in a roadway, as shown, the unit hole 62 is dug through the finished road grade 122 and into the substrate 124 below. In the exemplary embodiment, the unit hole 62 is approximately 6–8" in diameter and approximately 18–20" deep and is located approximately 24–36" from the manhole 102. Again, it will be appreciated that various other sizes and locations of the unit hole 62 are possible in the present invention and that the embodiment shown and described is merely exemplary. Essentially, the unit hole 62 is configured to house and protect the processor/transceiver unit 20 outside of the wastewater system 100. A cover 64 is installed over the unit hole 62 to securely enclose the processor/transceiver unit 20. The cover 64 is formed of a non-metal, synthetic material such as a composite nylon so as to minimize interference with wireless signal transmission from the processor/transceiver unit 20. A corrosion-resistant liner 66 also made of a synthetic material such as fiber-reinforced nylon may be installed within the unit hole 62 so as to further protect the processor/transceiver unit 20 and form a secure, moisture-tight seal with the cover 64. The cover 64 may be removably secured to the liner 66 employing any technique such as a threaded, snap-fit or tongue-and-groove arrangement now known or later developed in the art. A gasket or o-ring (not shown) may be further employed in effectuating a water-tight seal. Both the cover 64 and the liner 66 together thus form a caisson-type enclosure 60 that is water-tight and that meets all applicable UL, NEMA and DOT standards. With the enclosure 60 so formed, the processor/transceiver unit 20 is placed within the unit hole 62 and the cover 66 is secured in place. In the exemplary embodiment, the sensor 80 is a float-type, mechanical switch sensor located within the manhole 102 and connected to the processor/transceiver unit 20 via an electrical cable 28. To accommodate this arrangement, once the unit hole 62 is formed, a substantially horizontal cross-hole 70 is then formed so as to communicate between the unit hole 62 and the manhole 102, such hole 70 passing through the concrete wall 104 of the manhole 102, through the substrate 124, and through the liner 66. In this way, the cable 28 running from the sensor 80 may pass through the cross-hole 70 and be connected to the processor/transceiver unit 20. The cross-hole 70 may be lined or unlined. A corrosion-resistant sleeve 72 may be formed about a portion of the cable 28 and moisture-seal fittings 74 may be installed about the cable 28 at opposite ends of the cross-hole 70 and at the end of the sleeve 72 so as to protect the cable 28 and anchor the cable 28 within the manhole 102. While electrically wiring the processor/transceiver unit 20 and the sensor 80 together through the cable 28 has structural and operational advantages for the wireless wastewater system monitoring apparatus 10, as described below, it will also be appreciated that the processor/transceiver unit 20 and the sensor 80 can be configured to communicate wirelessly as well without departing from the spirit and scope of the present invention, particularly insofar as both wired and wireless communication allow for monitoring of wastewater levels while locating the processor/transceiver unit 20 external to the wastewater system 100. Moreover, while a float-type fluid level sensor 80 is shown and described, numerous other sensors may be employed in the present invention, including beam-, ultrasonic- and sonar-type sensors, for example, that may themselves even be located outside of the wastewater system 100 and, again, which may be wired or wirelessly connected to the processor/transceiver unit 20.

Figure 2:
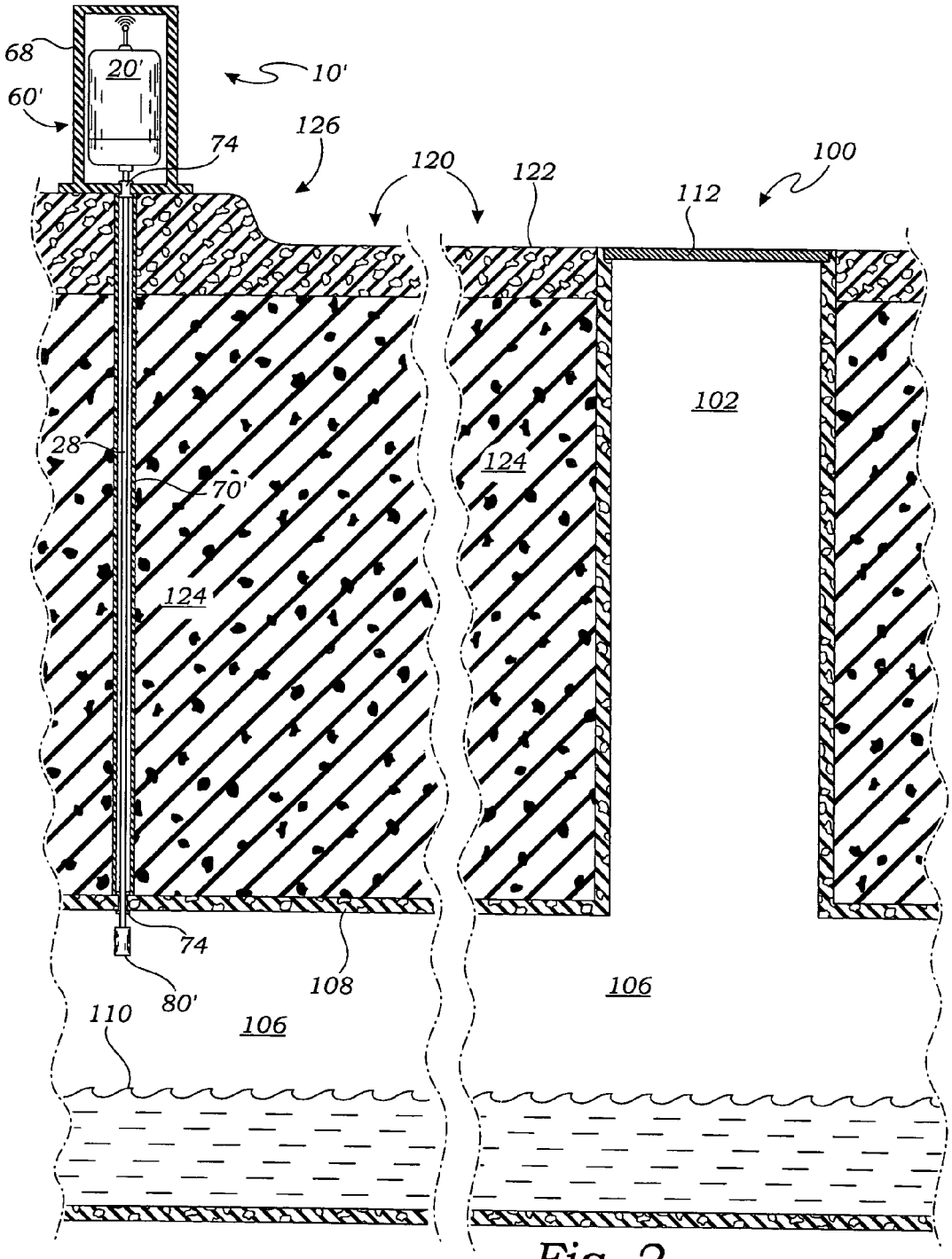
FIG. 2 is a sectional schematic of an alternative exemplary embodiment of the invention.

Turning now to FIG. 2, there is shown an alternative exemplary embodiment of the wireless wastewater system monitoring apparatus 10' of the present invention in which the enclosure 60' comprises an above-ground container 68 formed substantially of a non-metal, synthetic material so as to again minimize interference with wireless signal transmission from the processor/transceiver unit 20' while still weather-proofing and protecting the unit 20'. Such an arrangement may be advantageous where the manhole 102 to be monitored is not located in a roadway 120 or, as in the alternative exemplary embodiment wireless wastewater system monitoring apparatus 10' shown, a wastewater line 106 some distance from any manhole 102 is to be monitored, such as a line 106 running under a sidewalk or other area adjacent to a roadway 120. The container 68 may be located directly on the ground 124 or, as shown, on a sidewalk or concrete pad 126 outside of the roadway 120 for further stability and protection from the elements. In the exemplary embodiment, then, a substantially vertical cross-hole 70' may be formed so as to communicate between the container 68 and the wastewater line 106, the hole 70' passing through a wall of the container 68, the pad 126, the substrate 124, and the wall 108 of the wastewater line 106 so that the cable 28 running from the sensor 80' located within the wastewater line 106 may pass through the cross-hole 70' and into the container 68 to connect to the processor/transceiver unit 20'. Again, the cross-hole 70' may be lined or unlined and moisture-seal fittings 74 may be installed about the cable 28 at opposite ends of the cross-hole 70' so as to protect and anchor the cable 28. To provide access to the processor/transceiver unit 20', the container 68 may be formed with a cover, door, or other access opening (not shown) that is sealably secured. It will be appreciated by those skilled in the art that numerous other configurations of water-tight, protective enclosures 60, such as the container 68 shown, may be employed in the present invention so as to locate the processor/transceiver unit 20' outside of a wastewater system 100 that is to be monitored.

Figure 3:
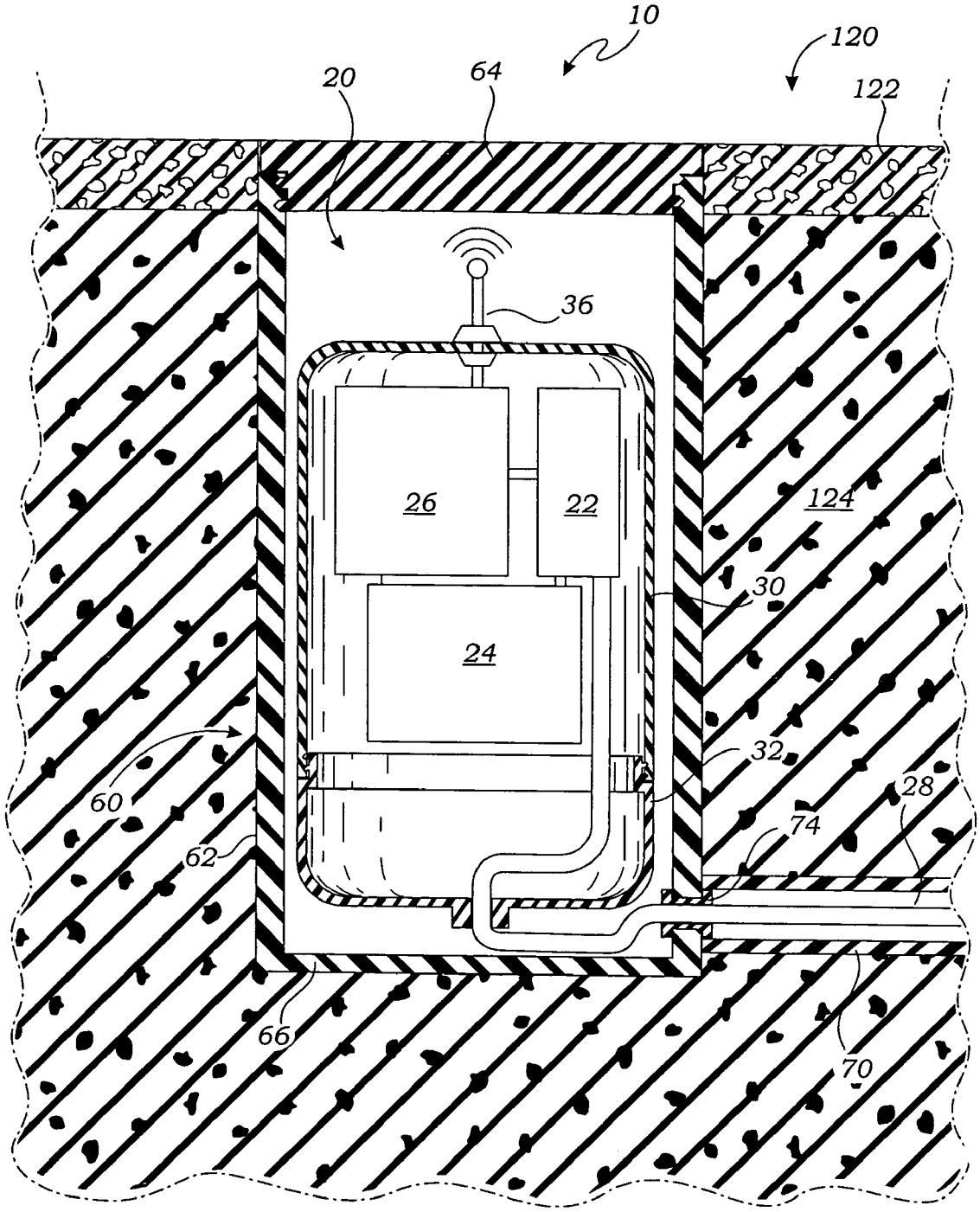
FIG. 3 is an enlarged partial sectional schematic of the exemplary embodiment of the invention shown in FIG. 1 taken from circle "3"
Figure 5:
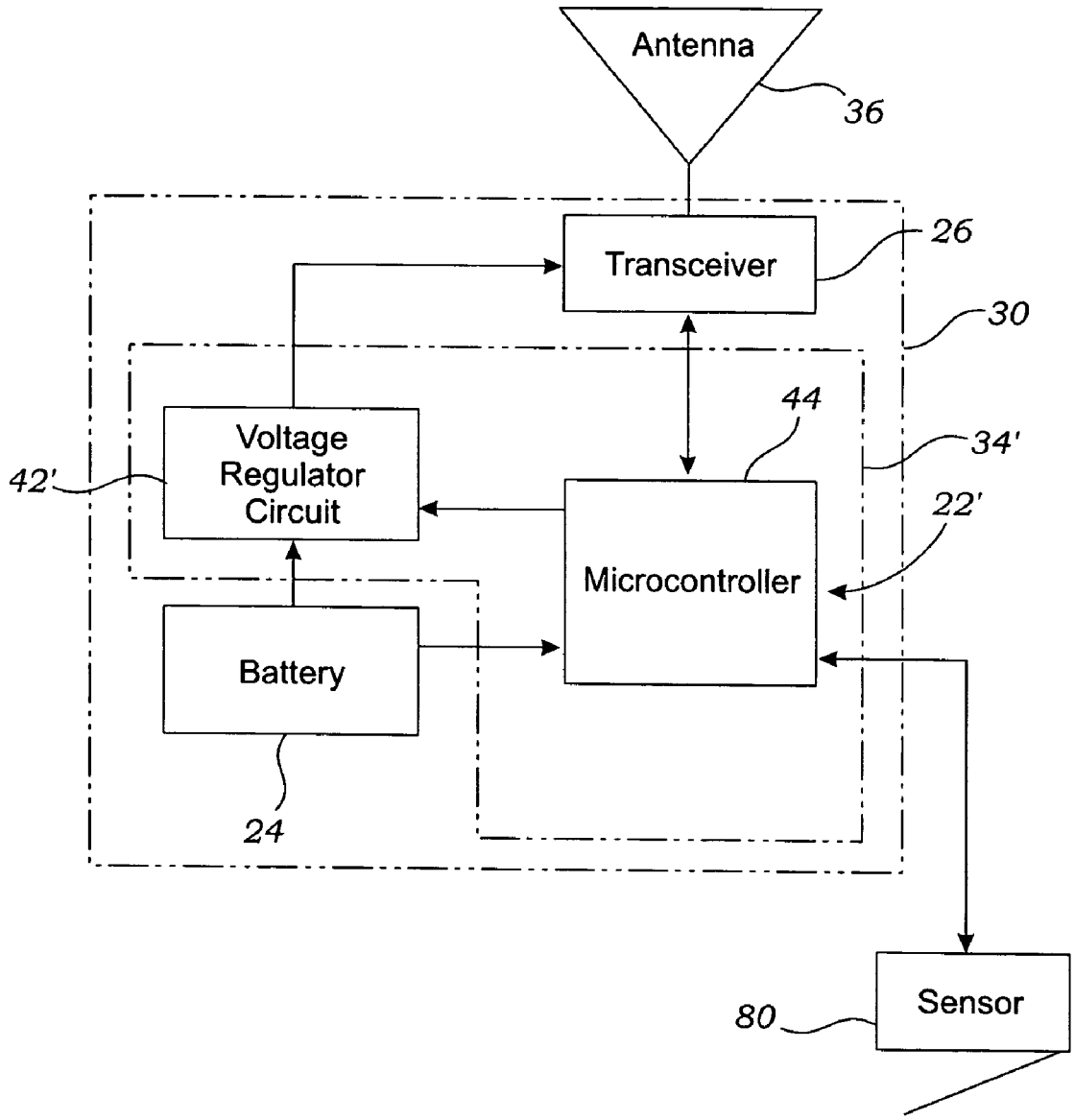
FIG. 5 is an electrical schematic of an alternative exemplary embodiment of the invention.

As shown in FIG. 3, the processor/transceiver unit 20 is configured with at least one microprocessor 22 wired between a power supply 24 and a transceiver 26. The microprocessor 22, such as a Phillips 8051 Series microprocessor, and the other processor/transceiver unit electronics are installed on a printed circuit board 34 (FIG. 5). The power supply 24 is preferably a 6V lantern-type battery, though numerous other batteries may be employed in powering the processor/transceiver unit 20 and sensor 80. The transceiver 26 may be a Motorola Creatalink CL2XT reflex transceiver transmitting at 901.2625 MHz and receiving at 941.0250 MHz and having a reflex text data rate of 6,400 baud. Further, the transceiver 26 may be equipped with an external antenna 36 having a 901–944 MHz, 30 degree vertical beam width and 3 db gain. It will be appreciated by those skilled in the art that each of these electronic components are exemplary and that other suitable components may be substituted without departing from the spirit and scope of the invention. For example, as explained below, two different embodiments of the microprocessor 22 configuration and related circuitry are disclosed, and numerous others are possible as well. Moreover, while the Motorola reflex transceiver 26 is shown and described in use below, numerous other wireless data transmission technologies, such as WiFi and WiMax transceivers, cellular transceivers and software transceivers, both now known or later developed in the art, may be employed in the present invention. Of course, as changes in the electronic components are made, the required power supply 24 may change accordingly, so that, again, the above 6V battery is merely illustrative for use in powering the other components employed in the exemplary embodiment shown and described. With continued reference to FIG. 3, all of these electronics are housed within a corrosion-resistant, moisture-tight housing 30 preferably having a moisture-seal cap 32 for selective access to the power supply 24. The cap 32 is shown as being threadably secured on the housing 30, though it will be appreciated that any moisture-tight securing mechanism now known or later developed may be used. The cap 32 may also be configured with a connector (not shown) for the sensor cable 28. Both the housing 30 and the end cap 32 may be formed of any suitable material, but are preferably made of a synthetic material such as nylon. The antenna 36 may extend from the housing 30, as shown, or be entirely contained within the housing 30.

With the wireless wastewater system monitoring apparatus 10 of the present invention so configured, the processor/transceiver unit 20 is, again, positioned within the protective enclosure 60 and the fluid level sensor 80 is located in the wastewater system 100. Whether the sensor 80 is placed in a manhole 102 (FIG. 1) or a wastewater line 106 (FIG. 2), it is positioned at a height above the normal fluid level 110 determined by the operator to be an overflow condition warranting an alarm notification. When thus installed in the field, as explained in more detail below, the processor/transceiver unit 20 defaults to a standby mode in which the sensor 80 is continuously powered by the power supply 24 and monitored across the cable 28 under the control of the microprocessor 22, while the other components of the processor/transceiver unit 20, including the transceiver 26, are not powered. When the fluid level 110 rises and an overflow condition is detected by the sensor 80, the sensor 80 sends an overflow signal via the cable 28 to the microprocessor 22 of the processor/transceiver unit 20. In response to the overflow signal, the microprocessor 22 then "awakens" the rest of the processor/transceiver unit 20 and transmits a wireless alarm signal via the transceiver 26 so that the operator can take appropriate action. It will be appreciated by those skilled in the art that the present invention thus provides for automated wastewater overflow notification while minimizing power consumption and wireless airtime by the processor/transceiver unit 20 being fully powered and sending a wireless alarm signal essentially only when an overflow condition has been detected. Because, as above, the alarm signal is sent from a location other than the manhole 102 so as to not be attenuated by the manhole cover 112 in particular, further power consumption is avoided by not having to increase signal strength in attempting to overcome these attenuating effects and the signal is transmitted more reliably. As such, the present invention provides for improved signal transmission and all but eliminates unit failures due to battery loss and to the corrosive effects of the wastewater system 100, ultimately resulting in more effective response to wastewater overflow conditions and a corresponding reduction in sewage spills.

Figure 4:
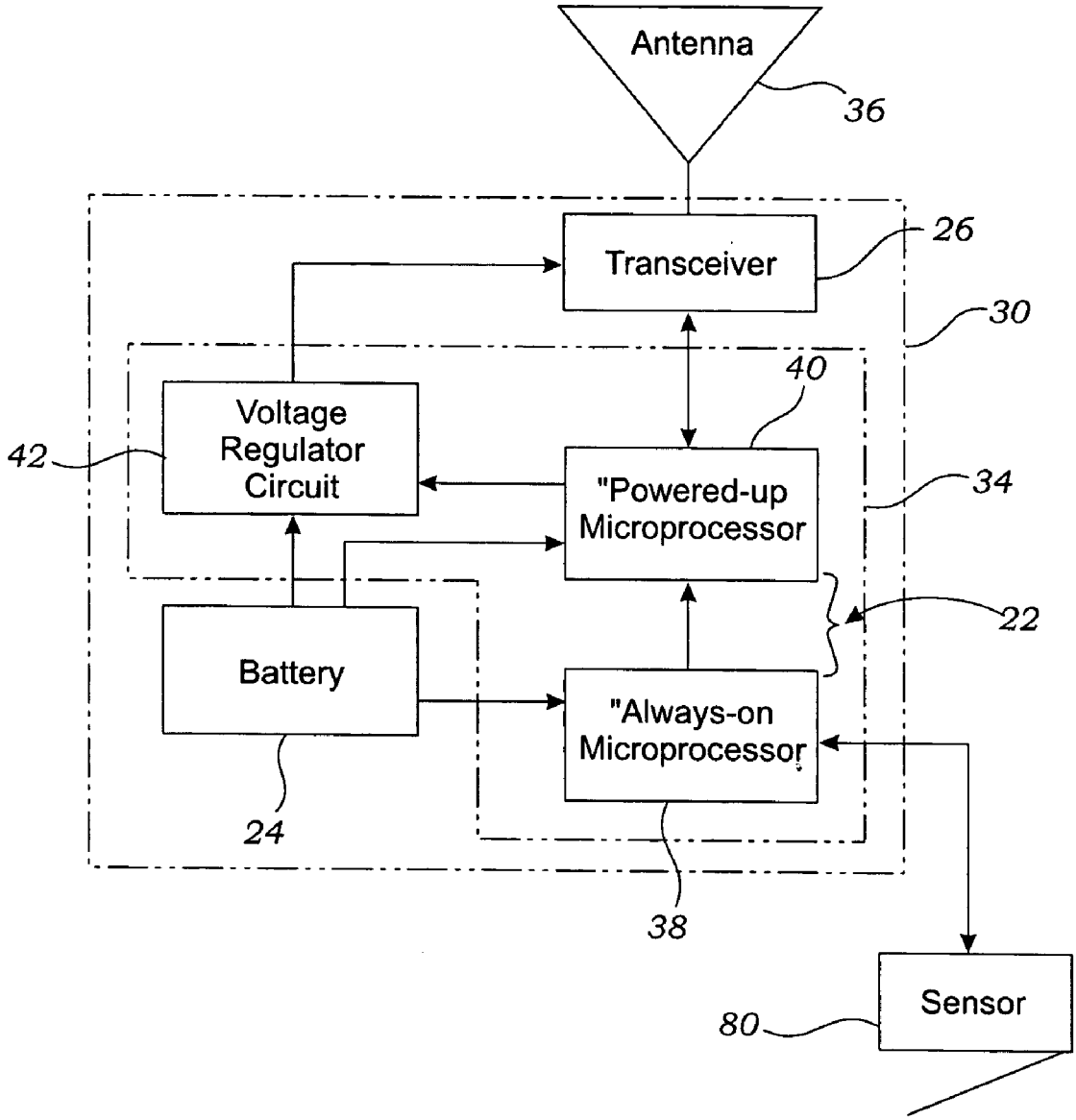
FIG. 4 is an electrical schematic of an exemplary embodiment of the invention.

Referring now to FIG. 4, there is shown a first exemplary embodiment of the circuitry of the processor/transceiver unit 20. Particularly, the at least one microprocessor 22 includes a first "always on" microprocessor 38 and a second "powered up" microprocessor 40. The "always on" microprocessor 38 is wired to the sensor 80 and to the power supply 24 and is configured to be constantly powered by the power supply 24 so as to continuously power and monitor the sensor 80, as in the standby mode described above. The "always on" microprocessor 38 is also wired to the "powered up" microprocessor 40 and is further configured to send an "awake" signal to the "powered up" microprocessor 40 when the overflow signal is received from the sensor 80. The "powered up" microprocessor 40 is wired to the "always on" microprocessor 38, also to the power supply 24, and to the transceiver 26 and is configured to be powered by the power supply 24 upon receipt of the awake signal from the "always on" microprocessor 38 so as to control the transceiver 26 to transmit the alarm signal. As shown, the transceiver 26 may be powered by the power supply 24 through a voltage regulator circuit 42 under the control of the "powered up" microprocessor 40. The "always on" microprocessor 38 is further configured to send an awake signal to the "powered up" microprocessor 40 at a regular interval, whether an overflow condition is detected or not, in order to perform a status-check of the wireless wastewater system monitoring apparatus 10, including the operation of the sensor 80 and the remaining power of the power supply 24. Such an awake or status-check signal effectively launches the "powered up" microprocessor 40 into a status-check mode, resulting in the transmission via the transceiver 26 under the control of the "powered up" microprocessor 40 of a status-result signal indicating whether the sensor 80 has a proper logic state and whether a low-battery condition exists. The interval for such status-checks, such as every two weeks, is programmed in the "always on" microprocessor 38. Again, it will be appreciated that by having only the "always on" microprocessor 38 and the sensor 80 powered constantly and the other components of the processor/transceiver unit 20, including the "powered up" microprocessor 40 and the transceiver 26, not powered unless an overflow condition is detected or a routine self-check is being conducted, the overall power consumption is reduced. In fact, the exemplary wireless wastewater system monitoring apparatus 10 can operate on a single 6 V battery for up to nine to twelve months depending on its activity level. In a preferred embodiment of the present invention, the battery-status signal will be included in any alarm signal sent from the processor/transceiver unit 20, whether in response to an overflow condition or during a routine status-check.

Turning to FIG. 5, there is shown an alternate exemplary embodiment of the circuitry of the processor/transceiver unit 20 wherein the at least one microprocessor 22' consists of a single microcontroller 44 having a standby clock mode and a normal clock mode. In the standby clock mode, only the sensor 80 and certain portions of the microcontroller 44 and other circuitry are constantly powered, again minimizing current consumption and maximizing battery life. The microcontroller 44 is configured to shift from the standby clock mode to the normal clock mode and power up the remainder of the processor/transceiver unit 20 upon receipt of the overflow signal from the sensor 80 or during the routine-interval status-check mode for which a time value is stored on the microcontroller 44. Once in normal clock mode, the microcontroller 44 turns on the voltage regulator circuit 42' wired to the microcontroller 44, to the power supply 24 and to the transceiver 26 so as to power up the transceiver 26 and transmit the alarm or status-result signal under the control of the microcontroller 44. In both the single microcontroller 44 embodiment (FIG. 5) and the dual microprocessor 28, 30 embodiment (FIG. 4) of the at least one microprocessor 22, 22', then, it will be appreciated that full power to the circuit and the ensuing wireless data transmission will only occur when prompted. Furthermore, those skilled in the art will appreciate that electrical connection to the sensor 80 enables the sensor 80 to be a relatively simple mechanical device without a separate processor or power supply. As such, the sensor 80, which is potentially exposed to the corrosive effects of the wastewater system 100 and increased wear and tear generally, thus has a decreased potential for failure and is relatively more compact and less expensive through its decreased number of components and complexity.

Figure 6:
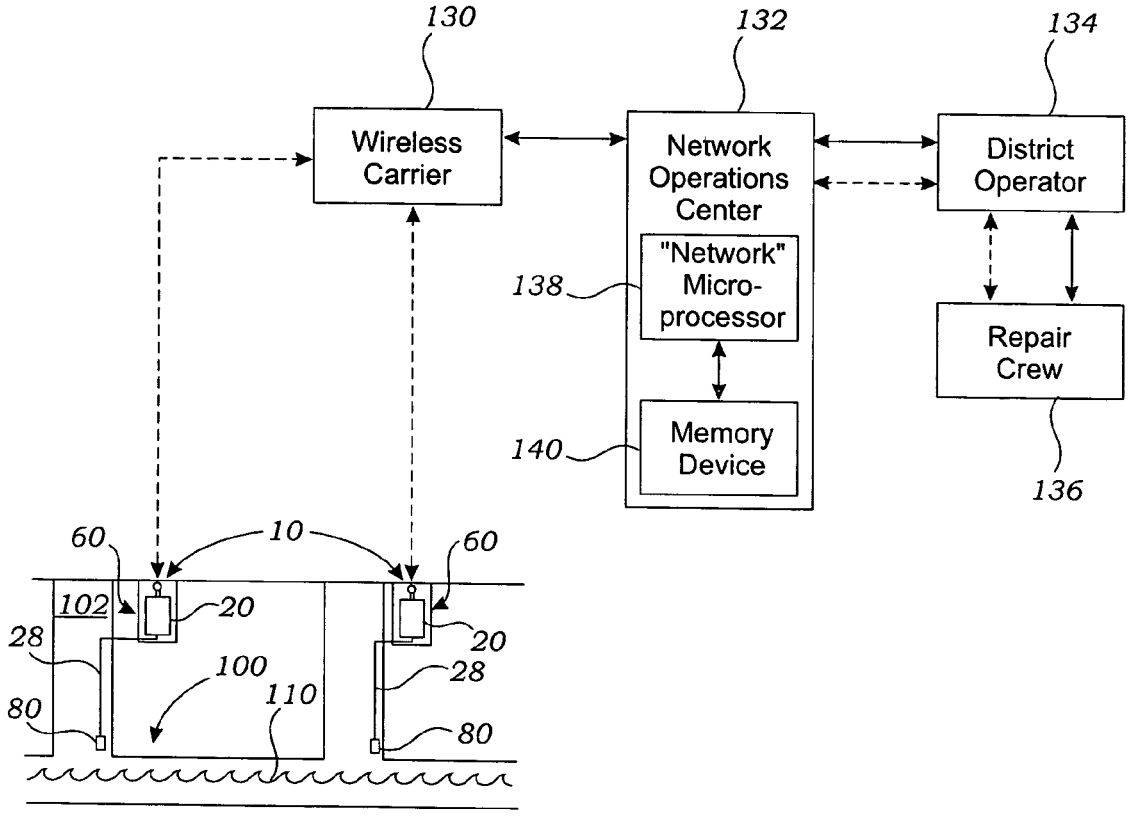
FIG. 6 is a system schematic of the exemplary embodiment of the invention shown in FIG. 1.

In FIG. 6 there is shown a wireless manhole monitoring system generally involving multiple wireless wastewater system monitoring devices 10 according to the present invention installed within a wastewater system 100 as described above and wirelessly linked to a network operations center 132. Specifically, one or more sensors 80 are located within respective one or more manholes 102, with each sensor again being configured to send an overflow signal when an overflow condition is detected. Correspondingly, one or more processor/transceiver units 20 are installed within respective one or more enclosures 60 and connected to respective ones of the sensors 80 through cables 28. While a single sensor 80 is shown as being connected to each processor/transceiver unit 20, it will be appreciated that any number of sensors 80 could potentially be connected to a single such unit 20. For the purpose of the following description of the entire wireless manhole monitoring system, each processor/transceiver unit 20 is assumed to be configured as in the embodiment of FIGS. 1 and 4, though it will be further appreciated, again, that numerous other configurations of the processor/transceiver unit 20 and its enclosure 60 are possible without departing from the spirit and scope of the present invention. With the processor/transceiver units 20 so installed, each unit 20 is assigned a unit number and uniquely associated with a particular manhole 102 or other location within the wastewater system 100 so that the units 20 can be mapped on a sewage grid for alarms and notifications. This geo-coded mapping data is stored in a database (not shown) at the network operations center 132. As described in more detail below, many other parameters concerning the operation of the processor/transceiver units 20 may be set and controlled through the network operations center 132.

In use, when each processor/transceiver unit 20 is in the standby mode, the respective sensor 80 is continuously monitored under the control of the first "always on" microprocessor 38 (FIG. 4) while the other components of the unit 20 are not powered, particularly the transceiver 26 (FIG. 4). When the wastewater level 110 rises to the level of a sensor 80, a float switch or the like initiates a contact closure and the sensor 80 sends an overflow signal along the cable 28 to the "always on" microprocessor 38. The "always on" microprocessor 38 then sends an awake signal so as to power the second "powered up" microprocessor 40 (FIG. 4) wired to the first microprocessor 38. In turn, the second microprocessor 40 then powers up and controls the transceiver 26 so as to transmit an alarm signal to the network operations center 132. For this purpose, an existing wireless carrier 130 provides for wireless communication to and from the processor/transceiver unit 20 in a manner known and used in the art, and transmission of the alarm signal from the wireless carrier 130 to the network operations center 132 may also be through any means now known or later developed, though a landline connection is shown. Again, other means of data transmission now known or later developed may be employed in relaying the alarm signal from the processor/transceiver unit 20 to the network operations center 132. In the case of wireless transmission of the alarm signal, it will be appreciated by those skilled in the art that the location of the processor/transceiver unit 20 within a synthetic enclosure 60 outside of the wastewater system 100 allows for more reliable transmission of the signal, as compared to transmission from within a manhole 102 where the structure of the manhole 102, and particularly the iron manhole cover 112 (FIG. 1), is known to interfere with, or attenuate, the transmission of wireless signals. The transmitted alarm signal contains the unit number of the processor/transceiver unit 20 that detected the overflow condition so that the appropriate notification can be provided, such that reliable transmission of the signal is critical to timely response and, ultimately, preventing an unwanted and costly sewage spill. Thus, when the alarm signal is received at the network operations center 132, a third "network" microprocessor 138, wired to a memory device 140 containing a database of geo-coded mapping data, accesses the database and compares the information contained in the alarm signal to the district sewage grid. Under the control of the "network" microprocessor 138, an alarm notification is then sent to the appropriate district operator 134 for corrective action. The interface between the network operations center 132 and the district operator 134 is preferably through an Internet web site. This web-site based interface provides for a series of notification alert capabilities defined by the district operator 134, including two-way paging, text messaging to cell phones, fax and e-mail. Other modes of communication now known or later developed may also be employed. The district operator 134, once notified, can then deploy a repair crew 136 to the proper location in the wastewater system 100 for immediate attention to the overflow condition detected by the wireless wastewater system monitoring apparatus 10. In addition to selecting the preferred mode of notification through the Internet web site interface, the district operator 134 can also select the scheduled interval on which alarm signals are sent from the wireless wastewater system monitoring apparatus 10. The alarm signals may be scheduled until the condition is remedied and the particular processor/transceiver unit 20 is reset by the repair crew 136, such as every 15 minutes, for example. Alternatively, the district operator 134 may choose to have the alarm signal resent on a regular interval only until receipt of the alarm signal is acknowledged. In any event, once the alarm signal is received by the district operator 134, the repair crew 136 is dispatched to the overflow location to correct the condition. The processor/transceiver units 20 may be reset automatically once the overflow condition is corrected and the sensor 80 returned to its at-rest configuration with the contact closure again open. Or, the units 20 may include a reset switch (not shown) to be tripped by the repair crew 136 when servicing the wastewater system 100. When the units 20 are reset, a reset signal will be sent from the respective processor/transceiver unit 20 to the district operator 134, again through the network operations center 132 web site by way of the wireless carrier 130. Such a reset signal provides the district operator 134 with a record of timely service response. In addition to the basic alarm message and the unit number data, the alarm signal may also contain the voltage status of the battery 24 (FIGS. 3 and 4). In this way, the district operator 134's notification to the repair crew 136 can also include information related to the battery condition and any corrective action related to the battery 124 can be taken care of on the same service call. A battery status indicator (not shown) may also be located on each processor/transceiver unit 20 itself for a further alert to the repair crew 136 servicing the unit.

Each wireless wastewater system monitoring apparatus 10 of the wireless manhole monitoring system of the present invention may also be configured such that the respective processor/transceiver units 20 provide periodic status reporting to the network operations center 132 and, from there, to the appropriate district operator 134. Accordingly, the "always on" microprocessor 38 (FIG. 4) of each processor/transceiver unit 20 may be programmed to provide an awake or status-check signal at a regular interval so as to power the second "powered up" microprocessor 40 (FIG. 4), such as once every two weeks, for example. Once powered, the "powered up" microprocessor 40 may be programmed to verify the status of the processor/transceiver unit 20, including the logic state of the sensor 80, and the remaining power of the power supply 24 and to transmit a status-result signal to the network operations center 132 by the transceiver 26 (FIG. 4). The routine status-check reporting interval may be pre-programmed or selected by the district operator 134. Either way, the interval is stored in the memory of the "always on" microprocessor 38 so that the status-check signal may be generated appropriately. As with the alarm signal, the status-result signal may be transmitted on a regular interval until receipt by the district operator 134, or at least at the network operations center 132, is acknowledged. Regarding the power supply 24 (FIGS. 3 and 4), it will be appreciated, then, that the remaining power is preferably monitored both at regular intervals during status-checks and anytime there is an alarm condition. Moreover, the processor/transceiver unit 20 can be programmed to monitor the battery 24 constantly and automatically send a low-battery signal anytime a low-battery condition is detected. Those skilled in the art will thus appreciate that the wireless manhole monitoring system of the present invention provides for both alarm and routine status notification from a monitoring apparatus 10 to a network operations center 132 while minimizing the use of power and wireless airtime through the configuration of the processor/transceiver units 20 to be in a default standby mode so as to continuously monitor the wastewater system 100 while only awakening the rest of the unit 20 and transmitting a wireless signal when an overflow condition is detected or at the prescribed status-check interval. Power consumption may be reduced even further by configuring respective ones of the transceivers 26 as ultra-low-power so as to effectively serve as repeaters communicating signals back and forth within an established local area network of processor/transceiver units in which only one processor/transceiver unit 20 would be equipped with a higher power transceiver 26 for then sending the appropriate signal on to the network operations center 132 via the wireless carrier 130 as explained above. Such a local area network within a wide area network is yet another example of how the present invention can provide automated wireless wastewater system monitoring with decreased power consumption and increased efficiency. In an exemplary embodiment of the wireless manhole monitoring system, the "powered up" microprocessor 40 (FIG. 4) of the processor/transceiver unit 20 is programmed to compress the alarm, reset and status-result signals before transmitting them, and the "network" microprocessor 138 is likewise programmed to decompress the signals after being received at the network operations center 132. It will be appreciated by those skilled in the art that this compression/decompression capability further minimizes the total wireless airtime associated with alarm, reset and status notification by the wireless wastewater system monitoring apparatus 10, thereby contributing to the efficiency of the system. It will also be appreciated, again, that the same functions of transmitting signals essentially only when an overflow condition has been detected or a status-check is being performed and of compressing the signals before being sent can be achieved in other embodiments of the processor/transceiver unit 20 of the present invention, including the alternative embodiment wherein a single microcontroller 44 (FIG. 5) operates within the unit 20. Moreover, again, the location of the processor/transceiver units 20 outside of the wastewater system 100, and any manhole 102 specifically, makes the overall system more effective by further reducing power consumption and eliminating the exposure of the units to the corrosive environment of the wastewater system 100, thereby effectively extending the useful life of the units 20 in the field, and by improving the wireless transmission of data to and from the processor/transceiver units 20. Thus, the resulting wireless wastewater monitoring system of the present invention provides improved monitoring performance at reduced cost.

While the invention has been described with reference to at least two preferred embodiments, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A wireless wastewater system monitoring apparatus comprising:

a sensor configured to send an overflow signal when an overflow condition in a wastewater system is detected, the sensor being located within a manhole of the wastewater system;

an enclosure formed outside of the wastewater system;

a cross-hole formed so as to communicate between the manhole and the enclosure; and a processor/transceiver unit connected to the sensor via an electrical cable passing through the cross-hole, the processor/transceiver unit having at least one microprocessor wired between a power supply and a transceiver and being located within the enclosure and configured to transmit a wireless alarm signal therefrom in response to the overflow signal, whereby the alarm signal is less prone to interference when communicating the overflow condition.

2. The apparatus of claim 1 wherein:

the enclosure comprises a unit hole formed in the ground adjacent to the manhole; and a cover is installed over the unit hole to enclose the processor/transceiver unit, the cover being formed of a non-metal, synthetic material so as to minimize interference with wireless signal transmission from the processor/transceiver unit.

3. The apparatus of claim 2 further comprising a corrosion-resistant liner installed within the unit hole, the liner being configured to form a secure, moisture-tight seal with the cover.

4. The apparatus of claim 1 wherein the enclosure comprises an above-ground container formed substantially of a non-metal, synthetic material so as to minimize interference with wireless signal transmission from the processor/transceiver unit.

5. The apparatus of claim 1 wherein a corrosion-resistant sleeve is formed about a portion of the cable and moisture-seal fittings are installed about the cable at opposite ends of the cross-hole so as to protect the cable and anchor the cable within the manhole.

6. The apparatus of claim 1 wherein the processor/transceiver unit further comprises:

a first microprocessor wired to the sensor and to the power supply and configured to be constantly powered by the power supply so as to continuously power and monitor the sensor and to send an awake signal when the overflow signal is received from the sensor; and a second microprocessor wired to the first microprocessor, to the power supply, and to the transceiver and configured to be powered by the power supply upon receipt of the awake signal from the first microprocessor so as to control the transceiver to transmit the alarm signal.

7. The apparatus of claim 6 wherein the second microprocessor comprises a means for compressing the alarm signal before being transmitted by the transceiver.

8. The apparatus of claim 1 wherein:

the at least one microprocessor comprises a microcontroller having a standby clock mode and a normal clock mode, the microcontroller being configured to shift from the standby clock mode to the normal clock mode upon receipt of the overflow signal from the sensor; and the processor/transceiver unit further comprises a voltage regulator wired to the microcontroller, to the power supply and to the transceiver, the voltage regulator being configured to respond to an awake signal sent by the microcontroller when in the normal clock mode so as to power up the transceiver to transmit the alarm signal under the control of the microcontroller.

9. The apparatus of claim 1 wherein the processor/transceiver unit further comprises a corrosion-resistant, moisture-tight housing.

10. The apparatus of claim 9 wherein the housing is formed having a moisture-seal cap for selective access to the power supply.

11. The apparatus of claim 1 further comprising a means for transmitting a reset signal from the processor/transceiver unit in response to correction of the overflow condition detected by the sensor.

12. The apparatus of claim 1 further comprising a means for performing periodic self-checks of the status of the processor/transceiver unit.

13. A wireless wastewater system monitoring apparatus comprising:

a sensor configured to send an overflow signal when an overflow condition is detected; and a processor/transceiver unit connected to the sensor and having a power supply, a first microprocessor, a second microprocessor, and a transceiver, the first microprocessor being wired to the sensor and to the power supply and configured to be constantly powered by the power supply so as to continuously power and monitor the sensor and to send an awake signal when the overflow signal is received from the sensor, and the second microprocessor being wired to the first microprocessor, to the power supply, and to the transceiver and configured to be powered by the power supply upon receipt of the awake signal from the first microprocessor so as to control the transceiver to transmit a wireless alarm signal.

14. The apparatus of claim 13 wherein:

the sensor is located within a wastewater system;

the processor/transceiver unit is located within a unit hole formed outside of the wastewater system; and a cover is installed over the unit hole to enclose the processor/transceiver unit, the cover being formed of a non-metal, synthetic material so as to minimize interference with transmission of the alarm signal.

15. The apparatus of claim 14 wherein an electrical cable connects the sensor and the processor/transceiver unit, the cable passing through a cross-hole formed so as to communicate between the wastewater system and the unit hole.

16. A wireless wastewater system monitoring apparatus comprising:

a sensor located within a wastewater system and configured to send an overflow signal when an overflow condition is detected;

a processor/transceiver unit connected to the sensor and having a power supply, a first microprocessor, a second microprocessor, and a transceiver, the first microprocessor being wired to the sensor and to the power supply and configured to be constantly powered by the power supply so as to continuously power and monitor the sensor and to send an awake signal when the overflow signal is received from the sensor, and the second microprocessor being wired to the first microprocessor, to the power supply, and to the transceiver and configured to be powered by the power supply upon receipt of the awake signal from the first microprocessor so as to control the transceiver to transmit a wireless alarm signal, the processor/transceiver unit being located within a unit hole formed outside of the wastewater system; and a cover installed over the unit hole to enclose the processor/transceiver unit, the cover being formed of a non-metal, synthetic material so as to minimize interference with transmission of the alarm signal.

17. A wireless manhole monitoring system comprising:

one or more sensors located within respective one or more manholes, each sensor being configured to send an overflow signal when an overflow condition is detected;

one or more processor/transceiver units, each processor/transceiver unit being electrically connected to one of the sensors and having a power supply, a first microprocessor, a second microprocessor, and a transceiver, the first microprocessor being wired to the one sensor and to the power supply and configured to be constantly powered by the power supply so as to continuously power and monitor the one sensor and to send an awake signal when the overflow signal is received from the one sensor, and the second microprocessor being wired to the first microprocessor, to the power supply, and to the transceiver and configured to be powered by the power supply upon receipt of the awake signal from the first microprocessor so as to control the transceiver to transmit an alarm signal, each processor/transceiver unit being located within a unit hole formed outside of the manhole;

a cover installed over the unit hole to enclose the processor/transceiver unit, the cover being formed of a non-metal, synthetic material so as to minimize interference with transmission of the alarm signal;

a wireless network; and a network operations center having a third microprocessor wired to a memory device containing a database, the third microprocessor being configured to access the database contained in the memory device in response to the alarm signal and to provide notification of the alarm signal.

18. The system of claim 17 wherein:

the second microprocessor comprises a means for compressing the alarm signal before being transmitted by the transceiver; and the third microprocessor comprises a means for decompressing the alarm signal after being received at the network operations center.

19. The system of claim 18 wherein the processor/transceiver unit further comprises a means for transmitting a reset signal in response to correction of the overflow condition.

20. The system of claim 18 wherein the processor/transceiver unit further comprises:

a means for sending a status-check signal from the first microprocessor so as to power the second microprocessor;

a means for verifying the status of the processor/transceiver unit and the remaining power of the power supply under the control of the second microprocessor; and a means for transmitting a status-result signal to the network operations center by the transceiver under the control of the second microprocessor.

21. A method of remote monitoring of a wastewater system comprising the steps of:

forming an enclosure outside of the wastewater system;

locating a processor/transceiver unit in the enclosure;

connecting the processor/transceiver unit to a sensor located within the wastewater system via a cable passing through a cross-hole formed between the wastewater system and the enclosure;

detecting an overflow condition in the wastewater system by the sensor;

sending an overflow signal from the sensor to the processor/transceiver unit;

transmitting an alarm signal from the processor/transceiver unit over a wireless network in response to the overflow signal, whereby the alarm signal being sent by the processor/transceiver unit located in the enclosure outside of the wastewater system is less prone to interference when communicating the overflow condition; and receiving the alarm signal at a network operations center.

22. The method of claim 21 comprising the further steps of:

lining the enclosure with a corrosion-resistant liner; and covering the enclosure with a cover so as to enclose the processor/transceiver unit, the cover being formed of a non-metal, synthetic material so as to minimize interference with transmission of the alarm signal.

23. The method of claim 21 comprising the further step of locating the sensor in the wastewater system.

24. The method of claim 23 comprising the further step of forming a cross-hole between the enclosure and the wastewater system so that the sensor and the processor/transceiver unit are connected by a cable passing through the cross-hole, the overflow signal being sent from the sensor to the processor/transceiver unit over the cable.

25. The method of claim 24 comprising the further steps of:

forming a corrosion-resistant sleeve about a portion of the cable; and installing moisture-seal fittings about the cable at opposite ends of the cross-hole so as to protect the cable and anchor the cable within the wastewater system.

26. The method of claim 21 comprising the further steps of:

continuously monitoring the sensor under the control of a first microprocessor installed in the processor/transceiver unit and wired to the sensor and to a power supply, the first microprocessor and the sensor being configured to be constantly powered by the power supply;

sending an awake signal from the first microprocessor when the overflow signal is received from the sensor; and powering a second microprocessor wired to the first microprocessor, to the power supply, and to a transceiver in response to the awake signal sent by the first microprocessor so as to transmit the alarm signal by the transceiver under the control of the second microprocessor.

27. The method of claim 26 comprising the further steps of:

accessing a database in response to the alarm signal under the control of a third microprocessor installed at the network operations center and wired to a memory device containing the database; and providing notification of the alarm signal under the control of the third microprocessor.

28. The method of claim 27 comprising the further steps of:

compressing the alarm signal by the second microprocessor before being transmitted by the transceiver; and decompressing the alarm signal by the third microprocessor after being received at the network operations center.

29. The method of claim 21 comprising the further steps of:

continuously monitoring the sensor under the control of a microcontroller installed in the processor/transceiver unit and wired to the sensor, to a power supply, and to a transceiver, the microcontroller having a standby clock mode in which the sensor is constantly powered by the power supply;

shifting the microcontroller to a normal clock mode when the overflow signal is received from the sensor; and powering the transceiver under the control of the microcontroller when in the normal mode so as to transmit the alarm signal by the transceiver.

30. The method of claim 21 comprising the further steps of:

responding to the alarm signal by correcting the overflow condition; and transmitting a reset signal from the processor/transceiver unit to the network operations center in response to correction of the overflow condition.

31. The method of claim 21 comprising the further steps of:

sending a status-check signal from a first microprocessor installed in the processor/transceiver unit and wired to a power supply, the first microprocessor being configured to be constantly powered by the power supply; and powering a second microprocessor wired to the first microprocessor, to the power supply, and to a transceiver in response to the status-check signal sent by the first microprocessor;

verifying the status of the processor/transceiver unit and the remaining power of the power supply under the control of the second microprocessor;

transmitting a status-result signal by the transceiver under the control of the second microprocessor; and receiving the status-result signal at the network operations center.

32. The method of claim 31 comprising the further step of programming the first microprocessor to send the status-check signal at a regular interval.

33. A method of remote monitoring of a wastewater system comprising the steps of:

locating a sensor in the wastewater system;

electrically connecting the sensor to a processor/transceiver unit;

continuously monitoring the sensor under the control of a first microprocessor installed in the processor/transceiver unit and wired to the sensor and to a power supply, the first microprocessor and the sensor being configured to be constantly powered by the power supply;

detecting an overflow condition by the sensor;

sending an overflow signal from the sensor to the first microprocessor in response to detection of the overflow condition;

sending an awake signal from the first microprocessor in response to the overflow signal sent by the sensor;

powering a second microprocessor wired to the first microprocessor, to the power supply, and to a first transceiver in response to the awake signal sent by the first microprocessor;

transmitting an alarm signal over a wireless network from the processor/transceiver unit by the first transceiver under the control of the second microprocessor; and receiving the alarm signal at a network operations center.

34. The method of claim 33 comprising the further steps of:

forming an enclosure outside of the wastewater system of a non-metal, synthetic material;

forming a cross-hole so as to connect the enclosure and the wastewater system;

locating the processor/transceiver unit in the enclosure; and passing a cable through the cross-hole so as to electrically connect the sensor and the processor/transceiver unit.

35. A wireless wastewater system monitoring apparatus comprising:

a sensor configured to send an overflow signal when an overflow condition is detected; and a processor/transceiver unit connected to the sensor and having a microcontroller wired between a power supply and a transceiver, the microcontroller being further wired to the sensor and having a standby clock mode and a normal clock mode, the microcontroller being configured to shift from the standby clock mode to the normal clock mode upon receipt of the overflow signal from the sensor, and the processor/transceiver unit further comprising a voltage regulator wired to the microcontroller, to the power supply and to the transceiver, the voltage regulator being configured to respond to an awake signal sent by the microcontroller when in the normal clock mode so as to power up the transceiver to transmit a wireless alarm signal under the control of the microcontroller.

* * * * *